US008456492B2

(12) United States Patent
Shidara et al.

(10) Patent No.: US 8,456,492 B2
(45) Date of Patent: Jun. 4, 2013

(54) DISPLAY DEVICE, DRIVING METHOD AND COMPUTER PROGRAM FOR DISPLAY DEVICE

(75) Inventors: Hidehiko Shidara, Tokyo (JP); Ken Kikuchi, Tokyo (JP); Yasuo Inoue, Tokyo (JP); Masahiro Ito, Kanagawa (JP); Hideto Mori, Kanagawa (JP)

(73) Assignee: Sony Corporation, Tokyo (JP)

( * ) Notice: Subject to any disclaimer, the term of this patent is extended or adjusted under 35 U.S.C. 154(b) by 924 days.

(21) Appl. No.: 12/120,421

(22) Filed: May 14, 2008

(65) Prior Publication Data

US 2008/0284702 A1 Nov. 20, 2008

(30) Foreign Application Priority Data

May 18, 2007 (JP) ..... 2007-133228

(51) Int. Cl.
*G09G 5/10* (2006.01)

(52) U.S. Cl.
USPC ..... 345/690; 345/77

(58) Field of Classification Search
USPC ..... 345/90, 77, 690
See application file for complete search history.

(56) References Cited

U.S. PATENT DOCUMENTS 6,952,193 B2 * 10/2005 Abe et al. ..... 345/87
6,987,521 B2 * 1/2006 Mori et al. ..... 345/690
7,139,008 B2 * 11/2006 Mori et al. ..... 345/690
7,414,622 B2 * 8/2008 Abe et al. ..... 345/204
7,414,795 B2 * 8/2008 Cok ..... 359/649
7,561,171 B2 * 7/2009 Mori et al. ..... 345/690
7,592,981 B2 * 9/2009 Maeda ..... 345/76
2001/0043179 A1 * 11/2001 Yoshinaga et al. ..... 345/87
2002/0021267 A1 * 2/2002 Walker et al. ..... 345/76
2003/0011545 A1 * 1/2003 Sagano et al. ..... 345/76
2003/0030654 A1 * 2/2003 Sagano et al. ..... 345/660
2003/0063053 A1 * 4/2003 Yamazaki et al. ..... 345/82
2003/0090488 A1 5/2003 Yoo (Continued)

FOREIGN PATENT DOCUMENTS

JP 08-063124 3/1996
JP 11-194745 7/1999

(Continued)

OTHER PUBLICATIONS

Communication from EP Patent Office for EP Application No. 08 752 808.9-1228 dated Mar. 19, 2012.

(Continued)

*Primary Examiner* — Dorothy Harris
(74) *Attorney, Agent, or Firm* — Dentons US LLP

(57) ABSTRACT

A display device includes: an average value calculating section which inputs video signals having linear property and calculates an average value of levels of the video signals in each pixel; an average value memory section which sequentially stores the average values calculated by the average value calculating section; a still image determining section which determines whether a still image is displayed on a present screen based on a difference between the average value stored in the average value memory section and a last average value; a coefficient calculating section which, when the determination is made that a still image is displayed on the present screen as a result of the determination in the still image determining section, calculates coefficients for lowering luminance of an image displayed on the display device; and a coefficient multiplying section which multiplies the video signals by the coefficients calculated by the coefficient calculating section.

7 Claims, 11 Drawing Sheets

U.S. PATENT DOCUMENTS

| | | | | |
|---|---|---|---|---|
| 2003/0210256 | A1 | 11/2003 | Mori et al. | |
| 2004/0239580 | A1* | 12/2004 | Nagatani et al. | 345/1.3 |
| 2005/0285828 | A1 | 12/2005 | Inoue et al. | |
| 2007/0080905 | A1* | 4/2007 | Takahara | 345/76 |
| 2007/0200803 | A1* | 8/2007 | Kimura | 345/76 |
| 2008/0136752 | A1* | 6/2008 | Inoue et al. | 345/77 |
| 2010/0134535 | A1* | 6/2010 | Shidara et al. | 345/690 |

FOREIGN PATENT DOCUMENTS

| | | |
|---|---|---|
| JP | 2001-337643 | 12/2001 |
| JP | 2003-280592 | 10/2003 |
| JP | 2005-003749 | 1/2005 |
| JP | 2005-043776 | 2/2005 |
| JP | 2006-195306 | 7/2006 |
| JP | 2006-259287 | 9/2006 |
| JP | 2006-284972 | 10/2006 |

OTHER PUBLICATIONS

EP Office Action dated Jul. 31, 2012 for EP Application No. 08 752 808.9-1228.

Japanese Office Action in connection with Japanese counterpart application No. 2009-515189 dated Jan. 8, 2013.

* cited by examiner

DISPLAY DEVICE, DRIVING METHOD AND COMPUTER PROGRAM FOR DISPLAY DEVICE

CROSS-REFERENCE TO RELATED APPLICATION

The present invention contains subject matter related to Japanese Patent Application JP 2007-133228 filed in the Japan Patent Office on May 18, 2007, the entire contents of which being incorporated herein by reference.

BACKGROUND OF THE INVENTION

1. Field of the Invention

The present invention relates to a display device and a control method for display device. More specifically, the invention relates to the active matrix type display device where scanning lines for selecting pixels in a predetermined scanning cycle, data lines for giving luminance information for driving the pixels, and pixel circuits for controlling a current amount based on the luminance information and allowing light emitting elements to emit light according to the current amount are arranged into a matrix pattern, and the driving method for the display device.

2. Description of the Related Art

As flat and thin display devices, liquid crystal display devices using liquid crystal and plasma display devices using plasma are coming into practical use.

Liquid crystal display devices are provided with backlight, change an arrangement of liquid crystal molecules by means of application of a voltage, allow light from the backlight to be transmitted or cut off so as to display images. Plasma display devices apply a voltage to gas sealed into a substrate so as to be brought into a plasma state, and emit ultraviolet rays generated due to an energy generated at the time of returning from the plasma state to an original state to a fluorescence substance so as to obtain a visible light and display images.

On the other hand, in recent years, self-emitting type display devices which use organic EL (electroluminescence) elements which emit light by application of a voltage are being developed. When organic EL elements receive energy due to electrolyzation, their ground state is changed into an excited state, and when the organic EL elements are returned from the excited state into the ground state, a differential energy is radiated as light. Organic EL display devices display images using the light radiated from the organic EL elements.

Self light emitting display devices do not require backlight because the elements emit light by themselves differently from the liquid crystal display devices which require backlight. For this reason, the self light emitting display devices can be made to be thinner than the liquid crystal display devices. Further, moving image property, view angle property and color reproducing property of the self light emitting display devices are more excellent than those of the liquid crystal displays. For this reason, the organic EL display devices attract attention as next-generation flat thin display devices.

However, when a voltage is continuously applied to the organic EL elements, their light emitting property is deteriorated, and even if an uniform electric current is input, their luminance is deteriorated. As a result, when light-emitting frequency of a particular pixel is high, the light emitting property of the particular pixel is inferior to that of the other pixels and images whose white balance is deteriorated are displayed. A phenomenon such that the light emitting property of a particular pixel is inferior to that of the other pixel is called as "burn-in phenomenon".

For example, Japanese Patent Application Laid-Open No. 2005-43776 discloses a method for converting luminance of images so as to retard the progression of the deterioration of the light emitting elements of the pixels due to time deterioration in properties and prevent the deterioration of white balance.

SUMMARY OF THE INVENTION

However, the method disclosed in Japanese Patent Application Laid-Open No. 2005-43776 has an issue such that a signal process becomes complicated because frequency distribution of gradation is calculated for input images and thus the images are binarized so that regions on which an fixed image is displayed are calculated.

Therefore, it is desirable to provide a new and improved display device which processes a video signal having linear property so as to detect presence/non-presence of display of a still image on a screen and adjusts the level of a video signal so as to prevent burn-in, a driving method and a computer program for the display device.

According to an embodiment of the present invention, there is provided a display device which has a display section in which pixels which have light emitting elements for emitting light according to a current amount and pixel circuits for controlling an electric current applied to the light emitting elements according to video signals, scanning lines which supply selection signals for selecting the pixels for emitting light to the pixels in a predetermined scanning cycle, and data lines which supply the video signals to the pixels are arranged into a matrix pattern, includes: an average value calculating section which inputs video signals having linear property and calculates an average value of levels of the video signals having linear property in each pixel; an average value memory section which sequentially stores the average values calculated by the average value calculating section; a still image determining section which determines whether a still image is displayed on a present screen based on a difference between the average value stored in the average value memory section and a last average value; a coefficient calculating section which, when the determination is made that a still image is displayed on the present screen as a result of the determination in the still image determining section, calculates coefficients for reducing luminance of an image displayed on the display section; and a coefficient multiplying section which multiplies the video signals by the coefficients calculated by the coefficient calculating section.

According to this constitution, the average value calculating section inputs video signals having linear property and calculates the average value of the levels of the video signals having linear property, the average value memory section successively stores the average values calculated by the average value calculating section. Further, the still image determining section determines whether a still image is displayed on a present screen based on a difference between the average value stored in the average value memory section and a last average value, and when the determination is made that the still image is displayed on the present screen as a result of the determination in the still image determining section, the coefficient calculating section calculates coefficients for reducing luminance of an image displayed on the display section. The coefficient multiplying section multiplies the video signals by the coefficients calculated by the coefficient calculating section. As a result, signal processes are executed on the video signals having linear property and presence/non-presence of the display of a still image on the screen is detected. The coefficients for adjusting the levels of the video signals are calculated according to the presence/non-presence of the still image, and the levels of the video signals are adjusted, thereby preventing a burn-in phenomenon on the screen.

The display device may further include a linear converting section which converts video signals having gamma property into the video signals having linear property. According to this constitution, the linear converting section converts video signals having gamma property into video signals having linear property. The video signals having linear property converted in the linear converting section are input into the average value calculating section, and the average value of levels of the video signals is calculated. As a result, various signal processes on the video signals can be easily executed.

The display device may further include a gamma converting section which converts output signals having linear property in the coefficient multiplying section into signals having gamma property. According to this constitution, the gamma converting section converts output signals having linear property in the coefficient calculating section into signals having gamma property. As a result, the video signals have gamma property, and thus the gamma property of the display section is cancelled. The video signals may have linear property so that self-light emitting elements in the display device emit light according to an electric current of the signals.

The still image determining section divides the display section into a plurality of regions and determines whether a still image is displayed on each region. When determining that a still image is displayed on at least one region, the still image determining section may determine that a still image is displayed on the entire screen.

The coefficient calculating section may calculate correction coefficients for reducing luminance of a region where an image having the highest luminance is displayed, or may calculate a correction coefficient for reducing the luminance of the entire screen.

The still image determining section may divide the display section into a plurality of regions so that a number of pixels on one side is an exponentiation of 2.

According to another embodiment of the present invention, there is provide a driving method for display device, the display device having a display section in which pixels which have light emitting elements for emitting light according to a current amount and pixel circuits for controlling an electric current applied to the light emitting elements according to video signals, scanning lines which supply selection signals for selecting the pixels for emitting light to the pixels in a predetermined scanning cycle, and data lines which supply the video signals to the pixels are arranged into a matrix pattern, includes the steps of: inputting video signals having linear property and calculating an average value of levels of the video signals in each pixel; storing the average values calculated at the average value calculating step; determining whether a still image is displayed on the display section based on a difference between the average value stored at the average value storing step and a last average value; when determining that a still image is displayed on the display section as a result of the determination at the still image determining step, calculating coefficients for reducing luminance of an image displayed on the display section; and multiplying the video signals by the coefficients calculated at the coefficient calculating step.

According to this constitution, at the average value calculating step, video signals having linear property are input, and an average value of levels of the video signals in each pixel is calculated. At the average value storing step, the averages values calculated at the average value calculating step are stored. At the still image determining step, a determination is made whether a still image is displayed on the display section based on a difference between the average value stored at the average value storing step and a last average value. At the coefficient calculating step, when the determination is made that the still image is displayed on the display section as a result of the determination at the still image determining step, coefficients for reducing luminance of an image displayed on the display section are calculated. At the coefficient multiplying step, the video signals are multiplied by the coefficients calculated at the coefficient calculating step. As a result, the signal process is executed on the video signals having linear property so that the presence/non-presence of the display of the still image on the screen is detected. The coefficients for adjusting the levels of the video signals are calculated according to the presence/non-presence of a still image, and the levels of the video signals are adjusted, so that the burn-in phenomenon on the screen can be prevented.

According to another embodiment of the present invention, there is provided a computer program which allows a computer to control a display device having a display section in which pixels which have light emitting elements for emitting light according to a current amount and pixel circuits for controlling an electric current applied to the light emitting elements according to video signals, scanning lines which supply selection signals for selecting the pixels for emitting light to the pixels in a predetermined scanning cycle, and data lines which supply the video signals to the pixels are arranged into a matrix pattern, includes the steps of: inputting video signals having linear property and calculating an averages value of levels of the video signals in each pixel; storing the average values calculated at the average value calculating step; determining whether a still image is displayed on the display section based on a difference between the average value stored at the average value storing step and a last average value; when determining that a still image is displayed on the display section as a result of the determination at the still image determining step, calculating coefficients for reducing luminance of an image displayed on the display section; and multiplying the video signals by the coefficients calculated at the coefficient calculating step.

According to this constitution, at the average value calculating step, video signals having linear property are input, and an average value of levels of the video signals in each pixel is calculated. At the average value storing step, the averages values calculated at the average value calculating step are stored. At the still image determining step, a determination is made whether a still image is displayed on the display section based on a difference between the average value stored at the average value storing step and a last average value. At the coefficient calculating step, when the determination is made that the still image is displayed on the display section as a result of the determination at the still image determining step, coefficients for reducing luminance of an image displayed on the display section are calculated. At the coefficient multiplying step, the video signals are multiplied by the coefficients calculated at the coefficient calculating step. As a result, the signal process is executed on the video signals having linear property so that the presence/non-presence of the display of the still image on the screen is detected. The coefficients for adjusting the levels of the video signals are calculated according to the presence/non-presence of a still image, and the levels of the video signals are adjusted, so that the burn-in phenomenon on the screen can be prevented.

According to the embodiments of the present invention described above, there is provided the new and improved display device which executes the signal processes on the video signals having linear property and detects the presence/non-presence of the display of a still image on the screen and adjusts the luminance so as to be capable of preventing the burn-in, and the driving method for the display device.

DETAILED DESCRIPTION OF THE PREFERRED EMBODIMENTS

Figure 1:
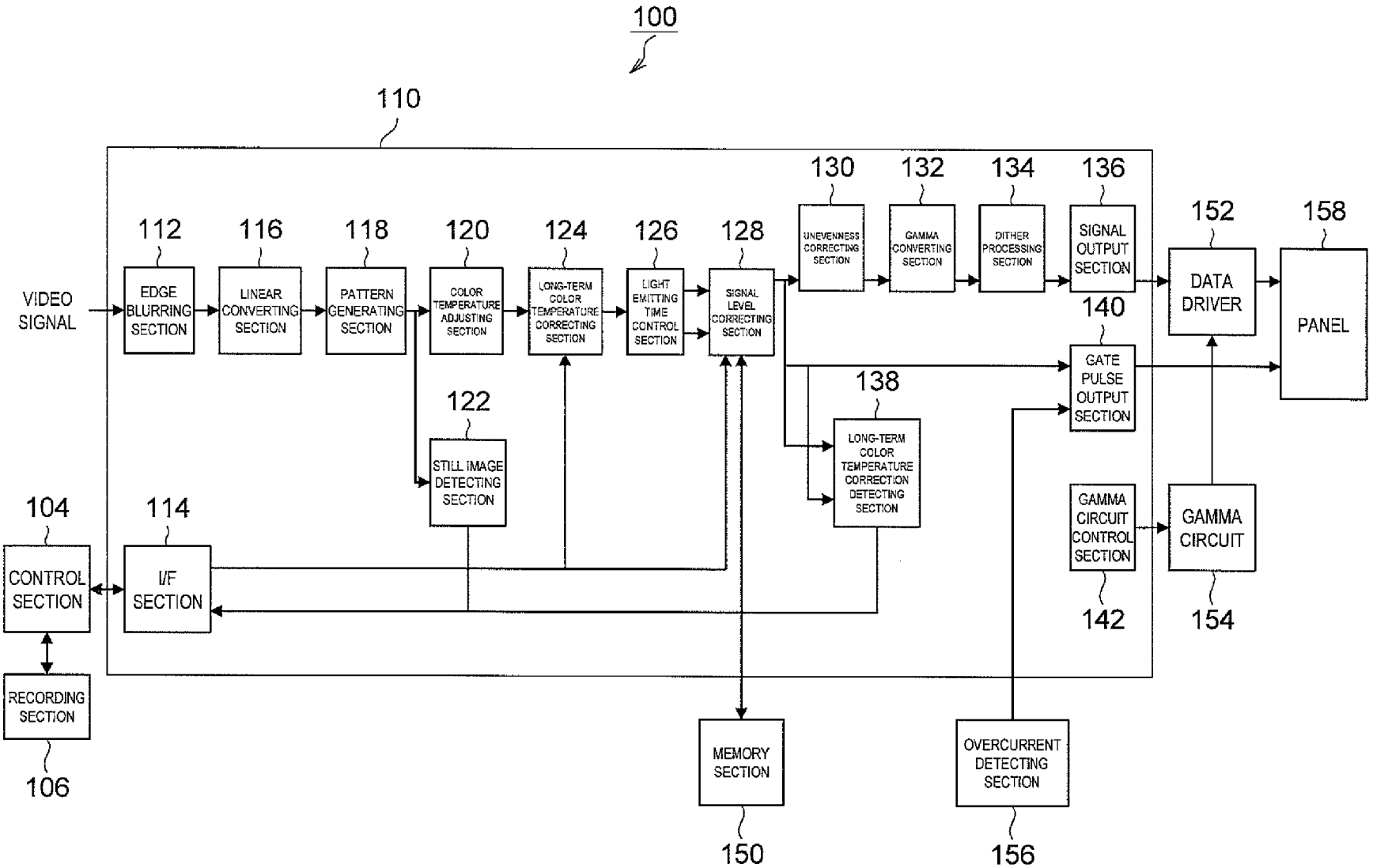
FIG. 1 is an explanatory diagram explaining a constitution of a display device 100 according to one embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

A constitution of a display device according to one embodiment of the present invention is described. FIG. 1 is an explanatory diagram explaining the constitution of the display device 100 according to one embodiment of the present invention. The constitution of the display device 100 according to one embodiment of the present invention is described below with reference to FIG. 1.

As shown in FIG. 1, the display device 100 according to one embodiment of the present invention includes a control section 104, a recording section 106, a signal processing integrated circuit 110, a memory section 150, a data driver 152, a gamma circuit 154, an overcurrent detecting section 156 and a panel 158.

The signal processing integrated circuit 110 includes an edge blurring section 112, an I/F section 114, a linear converting section 116, a pattern generating section 118, a color temperature adjusting section 120, a still image detecting section 122, a long-term color temperature correcting section 124, a light emitting time control section 126, a signal level correcting section 128, an unevenness correcting section 130, a gamma converting section 132, a dither processing section 134, a signal output section 136, a long-term color temperature correction detecting section 138, a gate pulse output section 140, and a gamma circuit control section 142.

When receiving a video signal, the display device 100 analyzes the video signal, and turns on pixels arranged in the panel 158, mentioned later, according to the analyzed contents, so a to display a video through the panel 158.

The control section 104 controls the signal processing integrated circuit 110 and sends/receives a signal to/from the I/F section 114. The control section 104 executes various signal processes on the signals received from the I/F section 114. The signal processes executed in the control section 104 include, for example, calculation of a gain to be used for adjusting luminance of an image displayed on the panel 158.

The recording section 106 stores information for controlling the signal processing integrated circuit 110 in the control section 104 therein. A memory, which can store information without deletion of the information even if a power of the display device 100 is turned off, is preferably used as the recording section 106. An EEPROM (Electronically Erasable and Programmable Read Only Memory), which can rewrite contents electrically, is desirably used as the memory which is adopted as the recording section 106. The EEPROM is a nonvolatile memory which can write or delete data with the EEPROM being packaged on a substrate, and is suitable for storing information in the display device 100 changing by the minute.

The signal processing integrated circuit 110 inputs a video signal and executes signal processes on the input video signal. In this embodiment, the video signal input into the signal processing integrated circuit 110 is a digital signal, and a signal width is 10 bits. The signal processes to be executed on the input video signal are executed in the respective sections in the signal processing integrated circuit 110.

The edge blurring section 112 executes a signal process for blurring an edge on the input video signal. Concretely, the edge blurring section 112 intentionally shifts an image and blurs its edge so as to repress a phenomenon of burn-in of the image to the panel 158.

The linear converting section 116 executes a signal process for converting a video signal whose output with respect to an input has a gamma property into a video signal having a linear property. When the linear converting section 116 executes the signal process so that the output with respect to the input has the linear property, various processes on images displayed on the panel 158 become easy. The signal process in the linear converting section 116 widens the signal width of the video signal from 10 bits to 14 bits.

The pattern generating section 118 generates test patterns to be used in the image processes in the display device 100. The test patterns to be used in the image processes in the display device 100 include, for example, a test pattern which is used for display check of the panel 158.

The color temperature adjusting section 120 adjusts color temperature of images, and adjusts colors to be displayed on the panel 158 of the display device 100. Not shown in FIG. 1, but the display device 100 includes a color temperature adjusting unit which adjusts color temperature, and when a user operates the color temperature adjusting unit, color temperature of images to be displayed on the screen can be adjusted manually.

The long-term color temperature correcting section 124 corrects deterioration with age due to variation in luminance-time property (LT property) of respective colors R (red), G (green) and B (blue) of organic EL elements. Since the organic EL elements have different LT properties of R, G and B, a color balance is deteriorated over light emitting time. The long-term color temperature correcting section 124 corrects the color balance.

The light emitting time control section 126 calculates a duty ratio of a pulse at the time of displaying an image on the panel 158, and controls the light emitting time of the organic EL elements. The display device 100 applies an electric current to the organic EL elements in the panel 158 while the pulse in an HI state, so as to allow the organic EL elements to emit light and displays an image.

The signal level correcting section 128 corrects the level of the video signal and adjusts the luminance of the video to be displayed on the panel 158 in order to prevent an image burn-in phenomenon. The image burn-in phenomenon is a phenomenon that the light emitting property is deterioration which is caused in the case where light emitting frequency of a specified pixel is higher than that of the other pixels. The luminance of the deteriorated pixel is lower than that of the other pixels which are not deteriorated, and a difference in the luminance becomes large between the deteriorated pixel and the peripheral non-deteriorated pixels. Characters are seemed to be burnt in the screen due to the difference in the luminance.

The signal level correcting section 128 calculates the amount of light emission of respective pixels or a pixel group based on the video signal and the duty ratio of the pulse calculated by the light emitting time control section 126, and calculates a gain for reducing the luminance according to need based on the calculated amount of luminance so as to multiply the video signal by the calculated gain.

The long-term color temperature correction detecting section 138 detects information for the correction in the long-term temperature correcting section 124. The information detected by the long-term color temperature correction detecting section 138 is sent to the control section 140 via the I/F section 114, and is recorded in the recording section 106 via the control section 104.

The unevenness correcting section 130 corrects unevenness of images and videos displayed on the panel 158. Horizontal stripes and vertical stripes of the panel 158 and unevenness of the entire screen are corrected based on the level of an input signal and a coordinate position.

The gamma converting section 132 executes a signal process for converting the video signal converted into a signal having linear property by the linear converting section 116 into a signal having gamma property. The signal process executed in the gamma converting section 132 is a signal process for canceling the gamma property of the panel 158 and converting a signal into a signal having a linear property so that the organic EL elements in the panel 158 emit light according to the electric current of the signal. When the gamma converting section 132 executes the signal process, the signal width changes from 14 bits into 12 bits.

The dither processing section 134 executes dithering on the signal converted by the gamma converting section 132. The dithering provides display where displayable colors are combined in order to express medium colors in an environment that the number of usable colors is small. When the dither processing section 134 executes dithering, colors which are not originally displayed on the panel are created apparently so as to be expressed. The signal width is changed from 12 bits into 10 bits by the dithering in the dither processing section 134.

The signal output section 136 outputs the signal which is dithered by the dither processing section 134 to the data driver 152. The signal sent from the signal output section 136 to the data driver 152 is a signal multiplied by information about the amount of light emission of respective colors R, G and B, and the signal multiplied by the information about the light emitting time is output in a form of a pulse from the gate pulse output section 140.

The gate pulse output section 140 outputs a pulse for controlling the light emitting time of the panel 158. The pulse output from the gate pulse output section 140 is a pulse obtained based on the duty ration calculated by the light emitting time control section 126. The pulse from the gate pulse output section 140 determines the light emitting time of each pixel on the panel 158.

The gamma circuit control section 142 gives a set value to the gamma circuit 154. The set value is a reference voltage given to ladder resistance of a D/A converter in the data driver 152.

The memory section 150 stores information necessary when a signal level is corrected in the signal level correcting section 128. Differently from the recording section 106, a memory in which contents are deleted when the power is turned off may be used as the memory section 150, and for example, SDRAM (Synchronous Dynamic Random Access Memory) is desirably used as such a memory. The information to be stored in the memory section 150 is described later.

The overcurrent detecting section 156 detects an overcurrent which is generated due to short-circuit of a substrate, and posts it to the gate pulse output section 140. The overcurrent detecting section 156 can prevent overcurrent, if generated, from being applied to the panel 158.

The data driver 152 executes a signal process on the signal received from the signal output section 136, and outputs a signal for displaying a video on the panel 158 to the panel 158.

The data driver 152 includes a D/A converter, and converts a digital signal into an analog signal so as to output the analog signal.

The gamma circuit 154 gives a reference voltage to the ladder resistance of the D/A converter included in the data driver 152. The reference voltage to be given to the ladder resistance is generated by the gamma circuit control section 142.

The panel 158 is one example of a display section of the present invention, and inputs an output signal from the data driver 152 and an output pulse from the gate pulse output section 140. The organic EL elements are allowed to emit light so that an image is displayed according to the input signal and pulse. The organic EL elements are self-light emitting elements which emit light when a voltage is applied, and their amount of light emission is proportional to the voltage. Therefore, an IL property (current-light-emission amount property) of the organic EL elements also has a proportional relationship.

In the panel 158, not shown, scanning lines, data lines and pixel circuits are arranged into a matrix pattern. The scanning lines are used for selecting pixels in a predetermined scanning cycle. The data lines are used for giving luminance information for driving the pixels. The pixel circuits control the amount of electric current based on the luminance information, and allow the organic EL elements as light emitting elements to emit light according to the amount of electric current. The provision of the scanning lines, the data line and the pixel circuits enable the display device 100 to display images.

The above described the constitution of the display device 100 according to one embodiment of the present invention with reference to FIG. 1. In the display device 100 according to one embodiment of the present invention shown in FIG. 1, after the linear converting section 116 converts a video signal into a signal having a linear property, inputs the converted video signal into the pattern generating section 118. However, the pattern generating section 118 and the linear converting section 116 may be interchanged.

A property transition of a signal flowing in the display device 100 according to one embodiment of the present invention is described below. FIGS. 2A to 2F are explanatory diagrams explaining property transitions of the signal flowing in the display device 100 according to one embodiment of the present invention using graphs. In the graphs in FIGS. 2A to 2F, an abscissa axis represents input and an ordinate axis represents output.

Figure 2A:
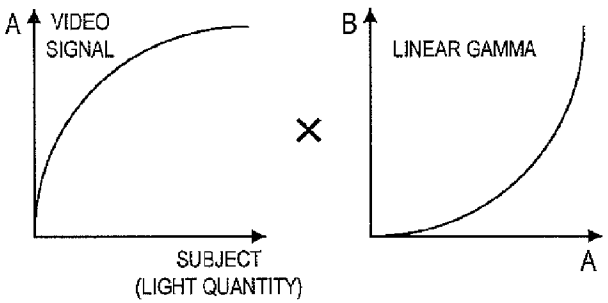
FIG. 2A is an explanatory diagram explaining a property transition of a signal flowing in the display device 100 using a graph according to one embodiment of the present invention.

In FIG. 2A, when a subject is input, the linear converting section 116 multiplies a video signal whose output A with respect to the light quantity of the subject has a gamma property by an inverse gamma curve (linear gamma) so as to convert the video signal into a video signal whose output with respect to the light quantity of the subject has a linear property.

Figure 2B:
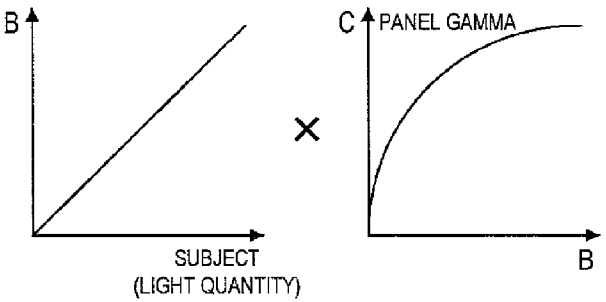
FIG. 2B is an explanatory diagram explaining a property transition of the signal flowing in the display device 100 using a graph according to one embodiment of the present invention.

In FIG. 2B, the gamma converting section 132 multiplies a video signal converted so that an output B with respect to the input of the light quantity of the subject has a linear property by a gamma curve, so as to convert the video signal into a video signal whose output with respect to the input of the light quantity of the subject has a gamma property.

Figure 2C:
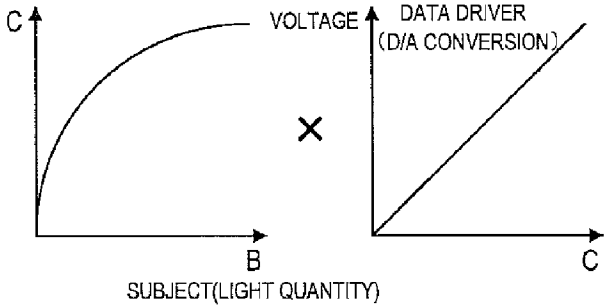
FIG. 2C is an explanatory diagram explaining a property transition of the signal flowing in the display device 100 using a graph according to one embodiment of the present invention.

In FIG. 2C, the data driver 152 converts a video signal, which is converted so that an output C with respect to the input of the light quantity of the subject has the gamma property, into an analog signal. In the D/A conversion, a relationship between input and output has the linear property. Therefore, the data driver 152 D/A converts a video signal, and when the light quantity of the subject is input, an output voltage has the gamma property.

Figure 2D:
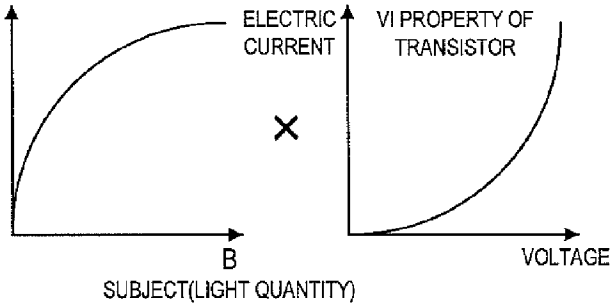
FIG. 2D is an explanatory diagram explaining a property transition of the signal flowing in the display device 100 using a graph according to one embodiment of the present invention.

In FIG. 2D, when the video signal which was subject to the D/A conversion is input into a transistor included in the panel 158, both gamma properties are cancelled. The VI property of the transistor is the gamma property which has a curve inverse to a gamma property of the output voltage with respect to the input of the light quantity of the subject. Therefore, when the light quantity of the subject is input, the conversion can be again carried out so that the output current has a linear property.

Figure 2E:
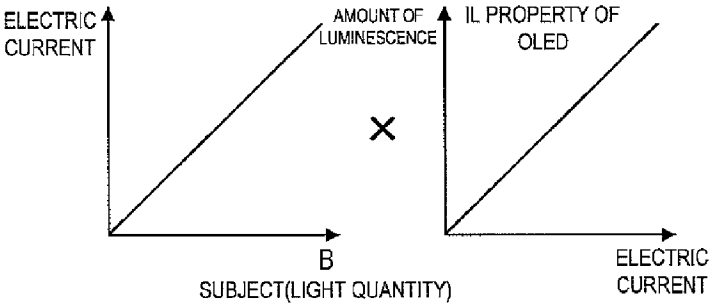
FIG. 2E is an explanatory diagram explaining a property transition of the signal flowing in the display device 100 using a graph according to one embodiment of the present invention.

In FIG. 2E, when the light quantity of the subject is input, the signal whose output current has a linear property is input into the panel 158. As a result, the signal having the linear property is multiplied by the IL property of the organic EL elements having the linear property.

Figure 2F:
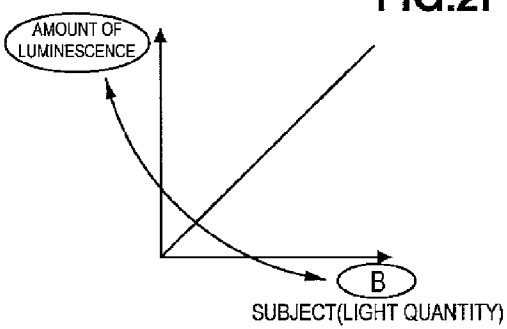
FIG. 2F is an explanatory diagram explaining a property transition of the signal flowing in the display device 100 using a graph according to one embodiment of the present invention.

As a result, as shown in FIG. 2F, when the light quantity of the subject is input, a portion between the linear converting section 116 and the gamma converting section 132 in the signal processing integrated circuit 110 shown in FIG. 1 can be subject to the signal processes as a rear region by multiplying the video signal by an inverse gamma curve so as to convert the video signal into a video signal having linear property in the linear converting section 116 because the amount of light emission of the panel (OLED; Organic Light Emitting Diode) has the linear property.

The above described the property transitions of the signals flowing in the display device 100 according to one embodiment of the present invention.

The signal level correcting section 128 and structural elements relating to the signal level correcting section 128 according to one embodiment of the present invention are described below.

Figure 3:
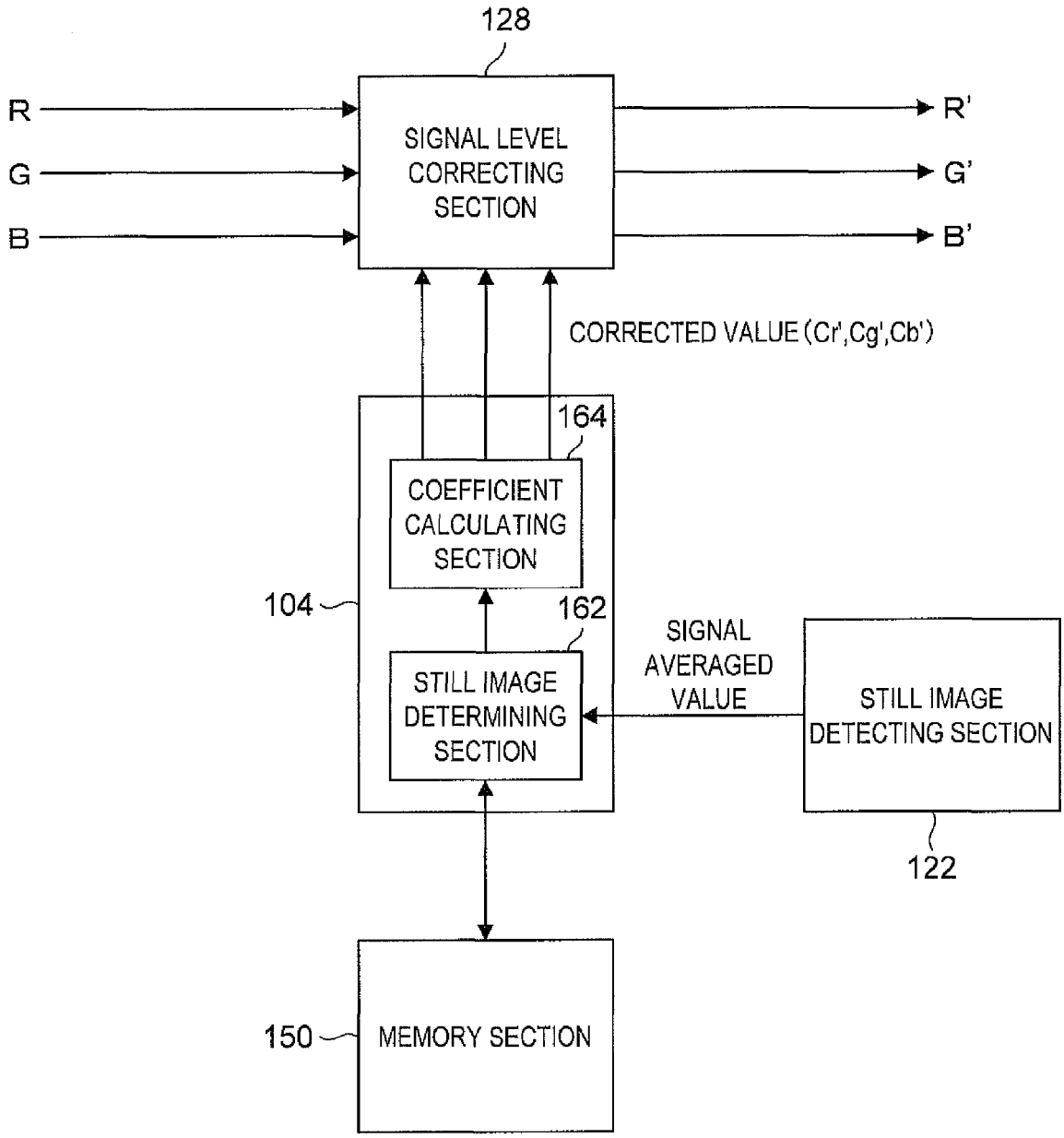
FIG. 3 is an explanatory diagram explaining a signal level correcting section 128 and structural components relating to the signal level correcting section 128.

FIG. 3 is an explanatory diagram explaining the signal level correcting section 128 and the structural elements relating to the signal level correcting section 128 according to one embodiment of the present invention. The signal level correcting section 128 and the structural elements relating to the signal level correcting section 128 according to one embodiment of the present invention are described below with reference to FIG. 3.

The still image detecting section 122 sequentially inputs video signals, and calculates an average value of the signal levels of respective colors R, G and B per pixel based on the input video signals. The control section 104 determines whether a still image is displayed by using the average value of the signal levels of respective colors R, G and B calculated by the still image detecting section 122.

The determination whether the still image is displayed according to this embodiment is made in each of divided regions which are obtained by dividing an image display region on the screen into a plurality of regions. For this reason, the still image detecting section 122 calculates the average value of the signal levels of respective colors R, G and B per pixel in each of the divided regions, and sends the calculated average value to the control section 104.

Figure 4:
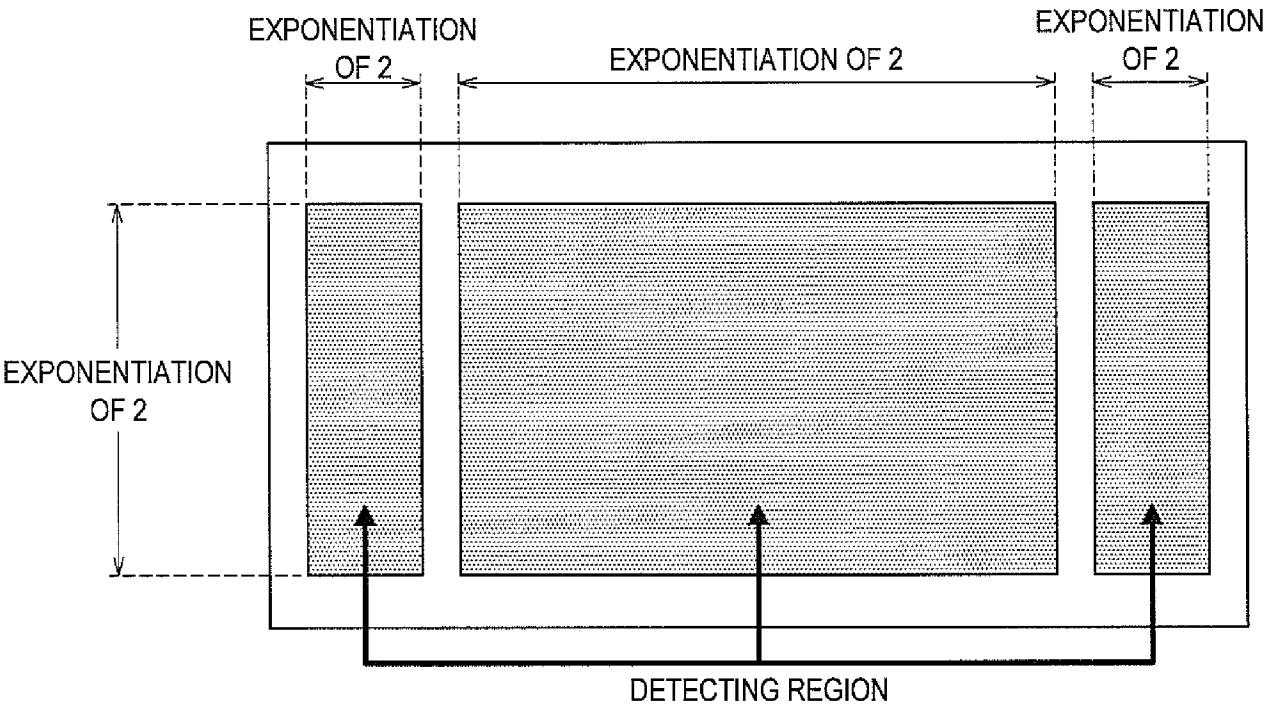
FIG. 4 is an explanatory diagram explaining division of an image display region on a screen according to one embodiment of the present invention.

FIG. 4 is an explanatory diagram explaining the division of the detecting region on the screen according to one embodiment of the present invention. As shown in FIG. 4, in this embodiment, the detecting region on the screen is divided so that the number of pixels of one side becomes an exponentiation of 2.

Figure 6:
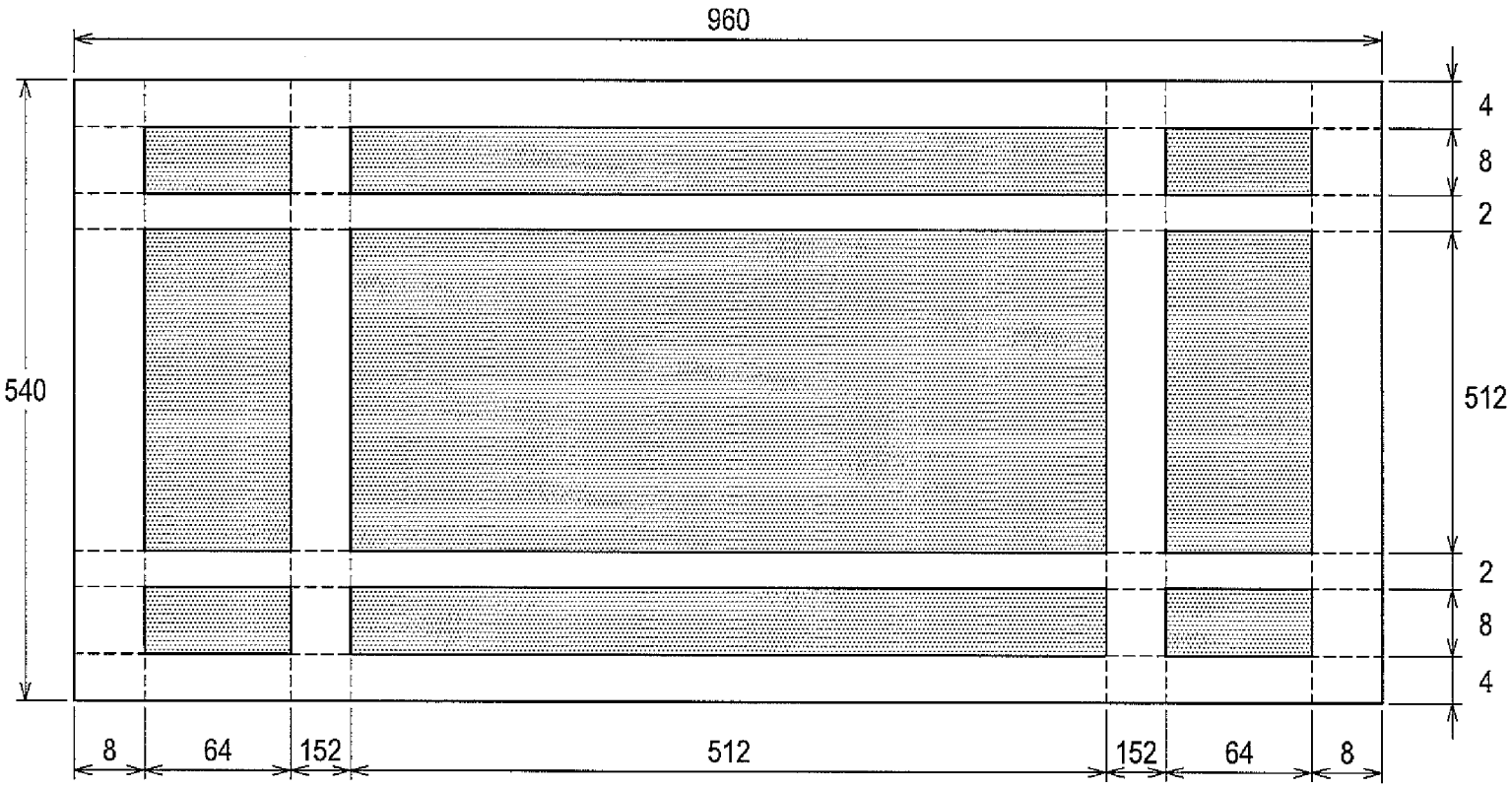
FIG. 6 is an explanatory diagram explaining division of the image display region on the screen according to one embodiment of the present invention.

FIG. 6 is an explanatory diagram explaining the division of the detecting region on the screen according to one embodiment of the present invention more concretely. As shown in FIG. 6, the display device 100 according to one embodiment of the present invention has the detecting region of 960 pixels (horizontal)×540 pixels (vertical). The detecting region is divided into nine regions so that the number of pixels on one side becomes an exponentiation of 2 as shown in FIG. 6.

In the example shown in FIG. 6, the divided regions include four regions which are 8 pixels long ($8=2^3$) and 64 pixels wide ($64=2^6$), two regions which are 512 pixels long ($512=2^9$) and 64 pixels wide, two regions which are 8 pixels long and 512 pixels wide, and one region which is 512 pixels long and wide. In FIG. 6, the values shown on the dimensional lines do not typically matches with actual lengths.

When the number of pixels on one side in each region is set to the exponentiation of 2, also the number of pixels in each region becomes the exponentiation of 2, and thus the average value of the signal levels can be easily calculated.

The average value of the signal levels of R, G and B per pixel is calculated in each region. Since the region which is 8 pixels long and 64 pixels wide includes 512 pixels, the signal levels of R, G and B are added and divided by 512 so that the average value of the signal levels is calculated.

It goes without saying that the number of divided regions and the number of pixels on one side in the present invention are not limited to the example shown in FIG. 6. In FIG. 6, as a result of dividing the screen into a plurality of regions, the respective regions have a rectangular shape, but the present invention is not limited to this, and the screen may be divided into a plurality of regions having a square shape.

In this embodiment, the screen is divided into a plurality of regions so that the average values of the signal levels are calculated, but the average value of the signal levels on the entire screen may be calculated without dividing the screen into a plurality of regions. However, when the average value of the signal levels on the entire screen is calculated, even if a video such that only one portion of the screen moves is displayed, it is difficult to detect a still image. For this reason, it is desirable to divide the screen into a plurality of regions and calculate the average values of the signal levels.

The control section 104 determines whether a region on which a still image is continuously displayed is present based on the information about the average value of R, G and B in each divided region output from the still image detecting section 122. When even one region on which the still image is continuously displayed is present, correction coefficients (gains) Cr', Cg' and Cb' for reducing the luminance are calculated in order to prevent the burn-in phenomenon so as to be sent to the signal level correcting section 128. Cr' is a correction coefficient for multiplying a red video signal, and Cg' is a correction coefficient for multiplying a green video signal, and Cb' is a correction coefficient for multiplying a blue video signal.

The control section 104 includes a still image determining section 162, and a coefficient calculating section 164. The still image determining section 162 determines whether an image displayed on the screen is a still image based on the average value output from the still image detecting section 122. When the determination is made that the still image is displayed on the screen by the still image determining section 162, the coefficient calculating section 164 calculates coefficients for reducing the luminance of an image displayed on the screen.

The still image determining section 162 determines a still image in the following manner. The information about the average value of the signal levels of respective colors in each region sent from the still image detecting section 122 is temporarily stored in the memory section 150. The last average value of the signal levels of respective colors in each region stored in the memory section 150 is compared with the present average value of the signal levels of respective colors in each region. When they are different by a predetermined value or more, the determination is made that a moving image is displayed. On the other hand, when they are different by a less than predetermined value, the determination is made that a still image is displayed.

When the control section 104 determines whether an image displayed on the screen is a still image, the control section 104 changes a value indicating a display degree of the still image according to the determined result. The display degree of still image is called "the degree of still image". The degree of still image is changed so that the control section 104 calculates a gain according to the degree of still image. When the gains are calculated according to the degree of still image, the luminance of an image displayed through the panel 158 is adjusted so that the burn-in phenomenon can be prevented.

The degree of still image is stored in the memory section 150. Since the degree of still image may be retained as information while the display device 100 is on, it is desirable to store it in the memory section 150 having volatile.

The signal level correcting section 128 inputs the video signal and the gain calculated by the control section 104, and multiplies the input video signal by the gain so as to output the video signal multiplied by the gain. When the signal level correcting section 128 multiplies the video signal by the gain, the level of the video signal is reduced, so that the luminance of the image displayed on the screen can be reduced. As a result, deterioration in the organic EL elements is repressed so that the burn-in phenomenon can be prevented.

The signal level correcting section 128 and the structural elements relating to the signal level correcting section 128 according to one embodiment of the present invention were described above. A still image determining method according to one embodiment of the present invention is described below.

Figure 5:
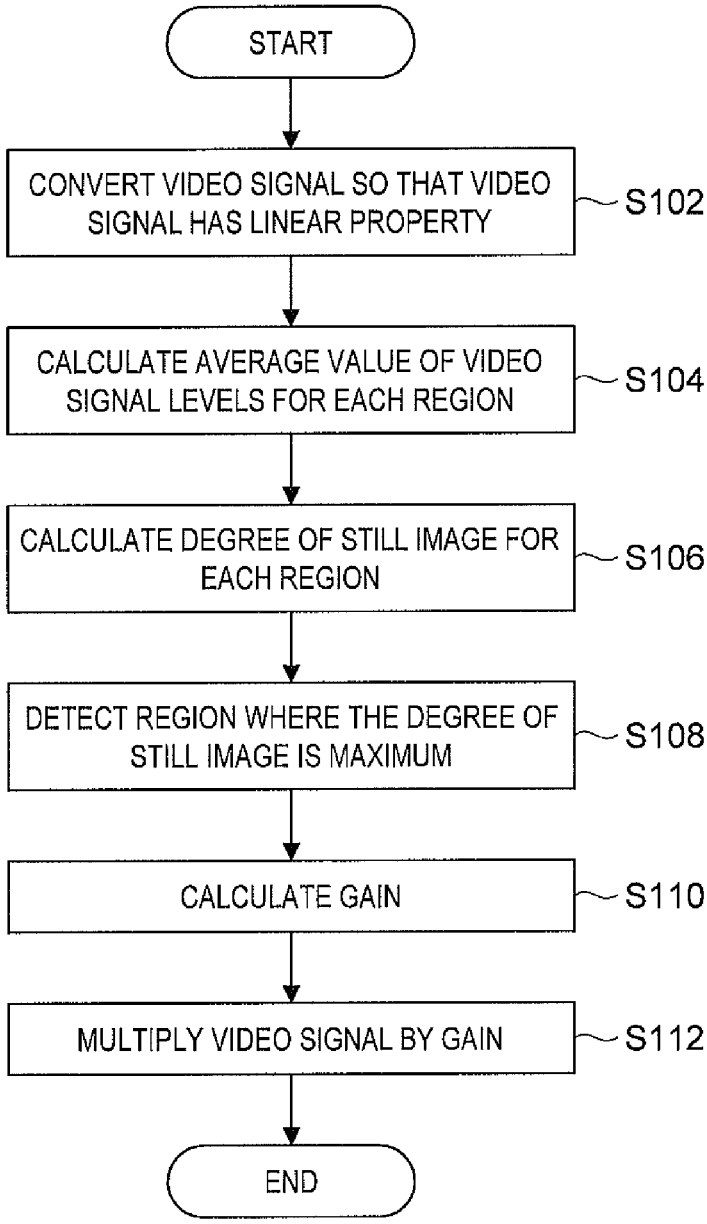
FIG. 5 is a flow chart explaining a still image determining method according to one embodiment of the present invention.

FIG. 5 is a flow chart explaining the still image determining method according to one embodiment of the present invention. The linear converting section 116 executes the converting process on a video signal having a gamma property so that the video signal has a linear property (step S102).

The still image detecting section 122 calculates the average value of the signal levels in each region based on the signal levels of R, G and B using the video signals input into the still image detecting section 122 (step S104). The average value of the signal levels is calculated by dividing the added signal levels in one region by the number of pixels.

In this embodiment, the signal level of one color per frame can be acquired from the input video signal. Therefore, the video signals for three frames are necessary for acquiring the signal levels of R, G and B.

Figure 7C:
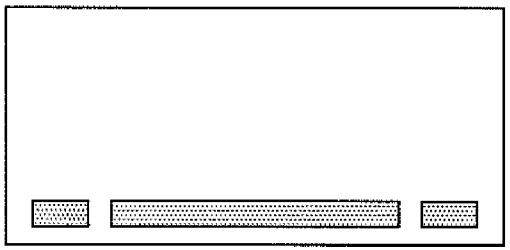
FIG. 7C is an explanatory diagram explaining a measuring order of the signal level in each region according to one embodiment of the present invention.
Figure 7B:
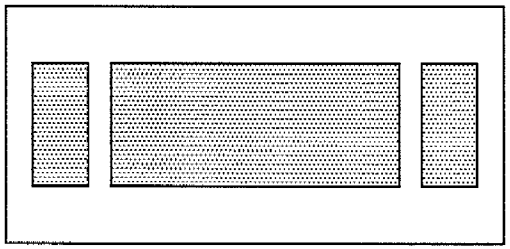
FIG. 7B is an explanatory diagram explaining a measuring order of the signal level in each region according to one embodiment of the present invention.
Figure 7A:
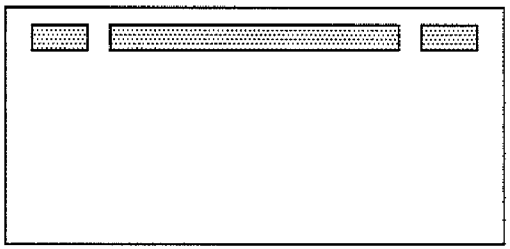
FIG. 7A is an explanatory diagram explaining a measuring order of the signal level in each region according to one embodiment of the present invention.
Figure 8:
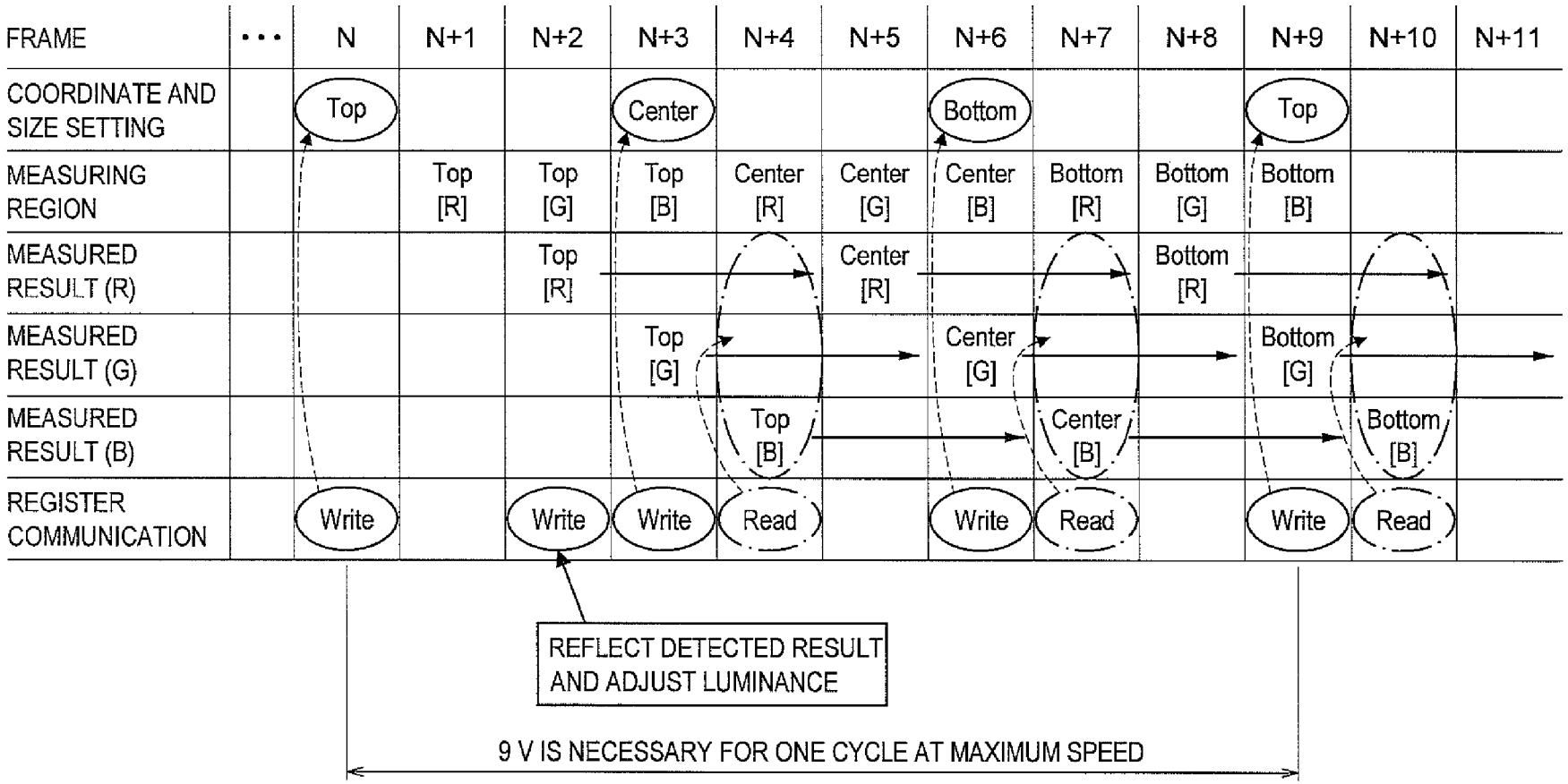
FIG. 8 is an explanatory diagram explaining the measurement of the signal level in a still image detecting section 122 according to one embodiment of the present invention.

FIGS. 7A to 7C are explanatory diagrams explaining the measuring order of the signal levels in each region according to one embodiment of the present invention. FIG. 8 is an explanatory diagram explaining the measurement of the signal levels in the still image detecting section 122. The flow of the measurement of the signal levels in the still image detecting section 122 is described with reference to FIGS. 7A to 7C and 8.

At the time point when the video signal of N-th frame is input into the still image detecting section 122, a coordinate and a size for the measurement are set. In the example shown in FIG. 8, at the time when the video signal of N-th frame is input into the still image detecting section 122, the measurement in a Top region, namely, a region shown in FIG. 7A is started.

At the time point when the video signal of (N+1)-th frame is input into the still image detecting section 122, a level of a red (R) video signal in the Top region shown in FIG. 7A is measured. At the time point when the video signal of (N+2)-th frame is input, a level of a green (G) video signal in the Top region is measured. At the time point when the video signal of (N+3)-th frame is input, a level of a blue (B) video signal in the Top region is measured. The values obtained by the measurements are temporarily retained in the still image detecting section 122. The measured results can be obtained at the time points when the video signals of (N+2)-th, (N+3)-th and (N+4)-th frames are input.

At the time point when the video signal of (N+4)-th frame is input, all the values of the signal levels of three colors R, G and B in the Top region are obtained.

At the time point when the video signal of (N+3)-th frame is input, the start of the measurement in a Center region, namely, the region shown in FIG. 7B is instructed.

At the time point when the video signal of (N+4)-th frame is input, a level of a red (R) video signal in the Center region is measured. At the time point when the video signal of (N+5)-th frame is input, a level of a green (G) video signal in the Center region is measured. At the time point when the video signal of (N+6)-th frame is input, a level of a blue (B) video signal in the Center region is measured. The values obtained by the measurements are retained. The measured results can be obtained at the time points when the video signals of (N+5)-th, (N+6)-th and (N+7)-th frames are input.

At the time point when the video signal of (N+7)-th frame is input, the values of signal levels of R, G and B are obtained in the Center region.

At the time point when the video signal of (N+6)-th frame is input, the starting of the measurement in a Bottom region, namely, the region shown in FIG. 7C is instructed.

At the time point when the video signal of (N+7)-th frame is input, a level of a red (R) video signal in the Bottom region is measured. At the time point when the video signal of (N+8)-th frame is input, a level of a green (G) video signal in the Bottom region is measured. At the time point when the video signal of (N+9)-th frame is input, a level of a blue (B) video signal in the Bottom region is measured. The values obtained by the measurements are retained. The measured results can be obtained at the time points when the video signals of (N+8)-th, (N+9)-th and (N+10)-th frames are input.

At the time point when the video signal of (N+10)-th frame is input, the values of the signal levels of R, G and B are obtained in the Bottom region.

In this embodiment, since the signal levels in the nine regions on the screen are obtained, the video signals for nine frames are necessary for obtaining the signal levels of three colors R, G and B in the nine regions. For this reason, the still image detecting section 122 successively acquires the signal levels of three colors R, G and B in the nine regions on the screen in a cycle of nine frames.

When the still image detecting section 122 acquires the signal levels of three colors R, G and B in each region on the screen, the average values of the acquired signal levels are successively calculated for respective regions. The calculated average values of the signal levels are sent from the still image detecting section 122 to the control section 104.

It goes without saying that the calculation timing of the average values of the signals levels is not limited to one type of timing. For example, the average values of the signal levels may be calculated at the time point when the signal levels of respective colors are completely acquired, or at the time point when the signal levels of R, G and B are completely acquired in one region, or at the time point when the signal levels of R, G and B are completely acquired in one screen, namely, all the nine regions.

When acquiring the average values of the signal levels in respective regions from the still image detecting section 122, the control section 104 determines whether a still image is displayed on the screen using the acquired average values of the signal levels in the respective regions. In this embodiment, the determination of still image is made based on whether differences between the last average values of the signal levels and the present average values of the signal levels are not less than a predetermined amount.

When the difference of any one color of R, G and B is not less than the predetermined amount, the control section 104 determines that a still image is displayed on the screen based on the present video signal. When the differences of all R, G and B colors are less than the predetermined amount, the still image determining section 162 determines that a still image is displayed on the screen based on the present video signals.

In this embodiment, since the signal levels of respective colors in all the regions on the screen can be acquired in the cycle of 9 frames, the determination of a still image in the still image determining section 162 is also made in the cycle of 9 frames.

Figure 9:
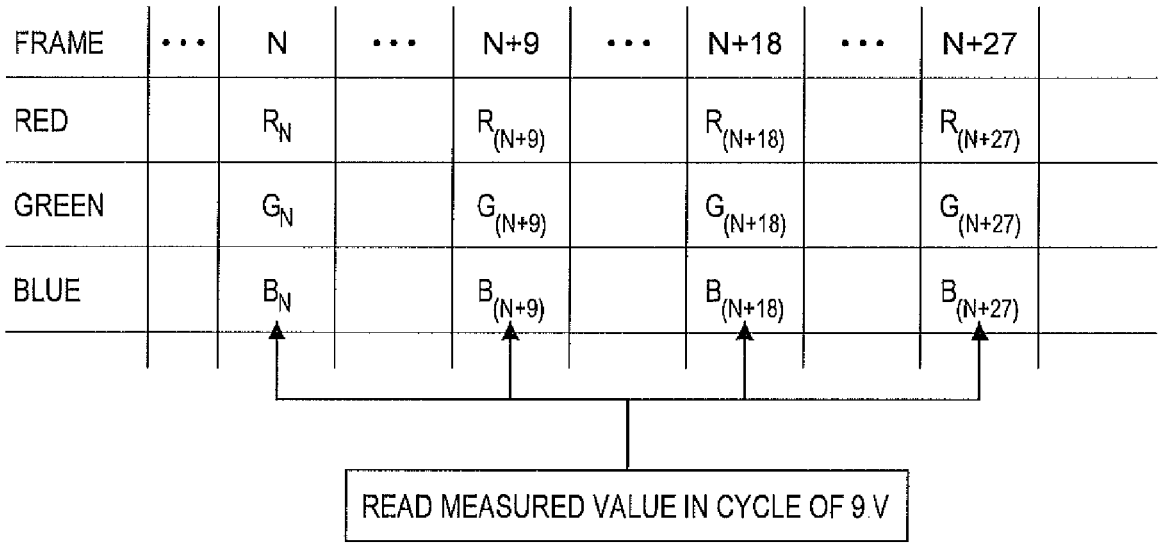
FIG. 9 is an explanatory diagram explaining the determination of a still image according to one embodiment of the present invention.

FIG. 9 is an explanatory diagram explaining the determination of still image according to one embodiment of the present invention. FIG. 9 describes the case where attention is focused on one region in the set nine regions on the screen and the average values of the signal levels of R, G and B are compared in the cycles of 9 frames (cycle of 9 V) so that the determination of still image is made.

In FIG. 9, $R_N$ shows the average value of the red (R) signal level at the time point when the video signal of N-th frame is input. Similarly, $G_N$ shows the average value of the green (G) signal level at the time point when the video signal of N-th frame is input, and $B_N$ shows the average value of the blue (B) signal level at the time of the video signal of N-th frame is input.

Since the average values of the signal levels of R, G and B are compared in the cycle of 9 frames (cycle of 9 V), the still image determining section 162 compares $R_N$ as the average value of the red signal level at the time point when the video signal of N-th frame is input with $R_{N+9}$ as the average value of the red signal level at the time point when the video signal of (N+9)-th frame is input. Similarly, the still image determining section 162 compares $G_N$ with $G_{N+9}$ as the average value of the green signal level at the time point when the video signal of (N+9)-th frame is input, and compares $B_N$ with $B_{N+9}$ as the average value of the blue signal level at the time point when the video signal of (N+9)-th frame is input.

As a result of comparing them, when the differences of the average values of the signal levels of respective colors are not less than a predetermined amount, the still image determining section 162 determines that a moving image is displayed on the region on the screen. On the other hand, when the differences in all the colors R, G and B are less than the predetermined amount, the control section 104 determines that a still image is displayed on the region on the screen.

When the still image determining section 162 makes the still image determination, it then calculates the degree of still image in the respective regions on the screen according to the result of the still image determination (step S106). The degree of still image is the degree of the display of a still image, and as the degree of still image is larger, a still image is displayed on that region continuously.

As a result of the still image determination in the still image determining section 162, when the determination is made that a still image is displayed on a certain region being subject to the determination, the degree of still image stored in the memory section 150 is increased by a predetermined amount.

On the other hand, as a result of the still image determination in the control section 104, when the determination is made that a moving image is displayed on a certain region being subject to the determination, the degree of still image stored in the memory section 150 is decreases by a predetermined about. In the present invention, the increasing amount and the decreasing amount of the degree of still image may be equal to each other, or may be different from each other. In this embodiment, the increasing amount of the degree of still image is larger than the decreasing amount.

Figure 10:
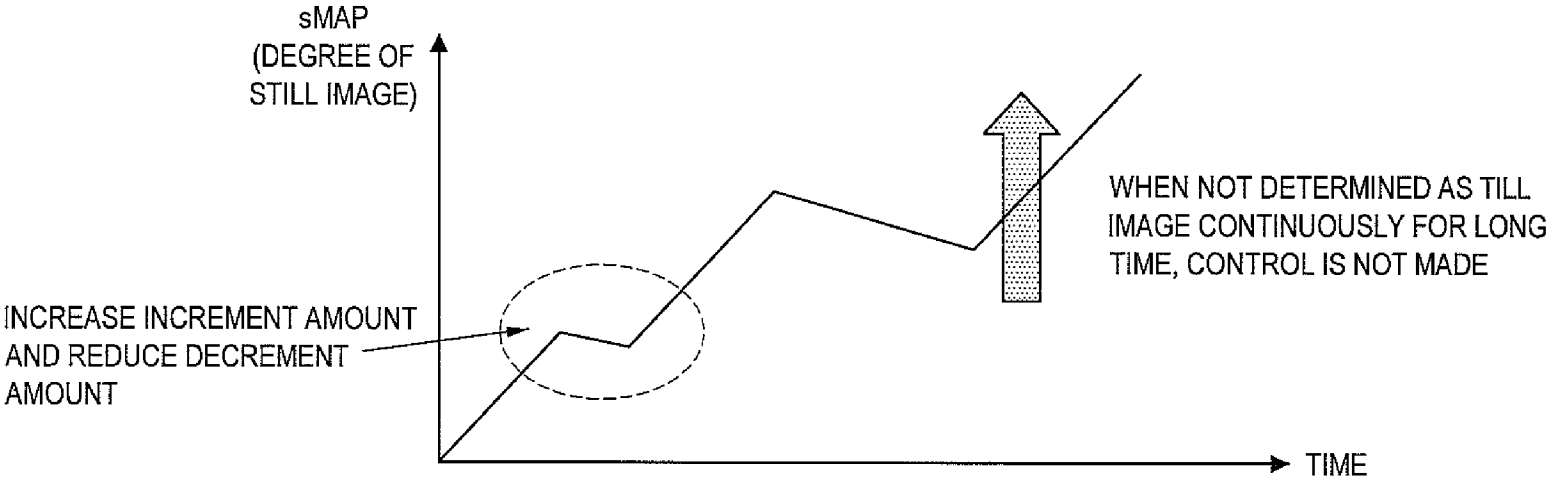
FIG. 10 is an explanatory diagram illustrating a graph of a relationship between the degree of still image and time according to one embodiment of the present invention.

FIG. 10 is an explanatory diagram illustrating a graph of a relationship between the degree of still image and the time according to one embodiment of the present invention. In the graph shown in FIG. 10, the abscissa axis represents the time, and the ordinate axis represents the degree of still image (sMAP), and the graph shows a state that the degree of still image increases or decreases over the time. As shown in FIG. 10, when the control section 104 determines that a still image is displayed continuously, the control section 104 calculates gains as described later. When the degree of still image is updated, the increasing amount of the degree of still image is set to be larger than the decreasing amount. As a result, if a moving image is not displayed for a longer time than the time for which a still image is displayed, the degree of still image does not return to an original level, and thus the burn-in phenomenon on the screen due to the display of a still image can be effectively repressed.

When the still image determining section 162 updates the degree of still image in each region on the screen stored in the memory section 150, the coefficient calculating section 164 detects the degree of still image in each region on the screen stored in the memory section 150 so as to check the presence of the region on which the still image is continuously displayed. When the coefficient calculating section 164 can confirm that a still image is continuously displayed on at least one region on the screen, the coefficient calculating section 164 calculates gains for reducing the luminance of an image displayed on the screen of the display device 100. The coefficient calculating section 164 calculates the gains for R, G and B colors.

Only the gains for reducing the luminance only in the regions where the still image is displayed may be calculated, or the gains for reducing the luminance on the entire screen may be calculated. However, when only the luminance in the regions where the still image is displayed is reduced, a sense of discomfort is possibly given to a person who views the image displayed on the display device 100. For this reason, it is desirable that the gains for reducing the luminance on the entire screen are calculated, and after the luminance on the entire screen is reduced a little, the luminance only in the region where the still image is displayed is reduced.

In this embodiment, two kinds of gains including the gain for reducing the luminance on the entire screen and the gain for reducing the luminance only in the region where the still image is displayed are calculated.

The gain calculating method in this embodiment is described concretely. The coefficient calculating section 164 acquires a region, which has the largest degree of still image in the degrees of still images in the nine regions on the screen stored in the memory section 150, and its degree of still image (step S108). When acquiring the region having the largest degree of still image and its degree of still image, the coefficient calculating section 164 calculates the correction coefficients (gains) Cr', Cg' and Cb' for multiplying video signals in the signal level correcting section 128 (step S110).

When the luminance is adjusted according to the largest degree of still image and a moving image is displayed in the region where the still image is displayed, the degree of still image is reduced. For this reason, the gains which are calculated according to the reduction in the degree of still image become large. As a result, the luminance of the image displayed on the screen rapidly increases, and the screen is seemed to be flashed. For this reason, it is desirable that the gains are not increased rapidly but the gains are increased gradually.

One method for increasing the gains gradually is a method for comparing the acquired maximum degree of still image with the maximum degree of still image acquired last time, so as to calculate the gains according to the compared result.

The latest maximum degree of still image is represented by sMAP_MAX_NEW, and the maximum degree of still image obtained last time is represented by sMAP_MAX_OLD. The sMAP_MAX_NEW is compared with the sMAP_MAX_OLD, and when the sMAP_MAX_NEW is less than the sMAP_MAX_OLD, the sMAP_MAX_OLD which is subtracted from a predetermined amount is the degree of still image to be used for calculating the gains. On the other hand, when the sMAP_MAX_NEW is not less than the sMAP_MAX_OLD, the sMAP_MAX_NEW is directly the degree of still image used for calculating the gains. The degree of still image used for calculating the gains are represented by sMAP_MAX'.

The acquired maximum degree of still image is compared with the maximum degree of still image acquired last time, and the gains are calculated according to the compared result. This can prevent the phenomenon such that the luminance of an image displayed on the screen increases rapidly at the time point when the display is switched from a still image into a moving image and thus the screen is seemed to be flashed. The predetermined amount which is subtracted from the sMAP_MAX_OLD can be set freely according to a design.

Figure 11:
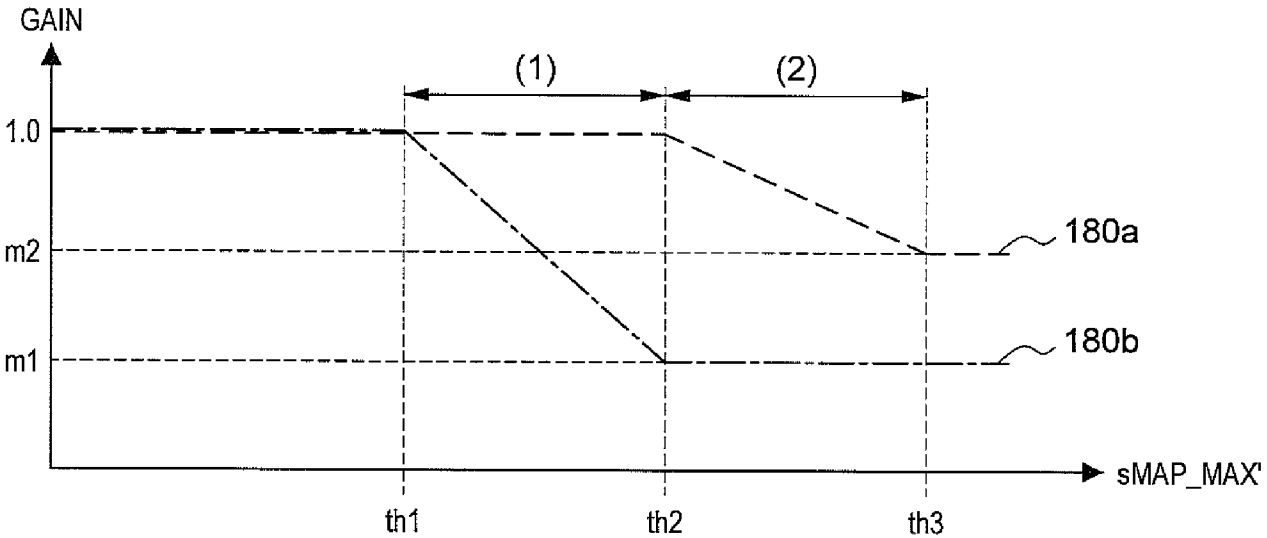
FIG. 11 is an explanatory diagram illustrating a graph of a relationship between the degree of still image and a gain according to one embodiment of the present invention.

FIG. 11 is an explanatory diagram illustrating a graph of a relationship between the degree of the still image and the gain according to one embodiment of the present invention. The abscissa axis of the graph shown in FIG. 11 represents the degree of still image sMAP_MAX' to be used for calculating the gains, and the ordinate axis represents the gain to be calculated.

A line shown by a symbol 180*a* in FIG. 11 shows the relationship between the degree of the still image and the gain at the time of calculating the gains for reducing the luminance on the entire screen, and a line shown by a symbol 180*b* shows the relationship between the degree of the still image and the gain at the time of calculating the gains for reducing the luminance in a region having high degree of still image, namely, a region where one still image is continuously displayed.

A zone shown by (1) in FIG. 11, namely, a zone where sMAP_MAX' is between th1 to th2 is a zone where the gain for reducing the luminance of an image displayed on the region with high degree of still image is calculated. While the degree of still image sMAP_MAX' is between 0 to th1, the gain to be calculated is 1.0. When the degree of still image increases and sMAP_MAX' reaches th1, the gain which is smaller than 1.0 is calculated in order to reduce the luminance of an image displayed on the region with high degree of still image. The gain is reduced from 1.0 and to m2 until the degree of still image sMAP_MAX' reaches th2.

A zone shown by (2) in FIG. 11, namely, a zone where the sMAP_MAX' is between th2 and th3 is a zone where the gain for reducing the luminance on the entire screen is calculated. While the degree of still image sMAP_MAX' is between 0 to th2, the gain to be calculated is 1.0. When the degree of still image increases and the sMAP_MAX' reaches th2, the gain which is smaller than 1.0 is calculated in order to reduce the luminance on the entire screen. When the degree of still image sMAP_MAX' is larger than th2, the gain to be calculated is reduced from 1.0 and to m1 until the degree of still image sMAP_MAX' reaches th3.

When two kinds of gains are calculated in such a manner, the luminance can be adjusted while a user who views the image on the display device 100 does not feel the deterioration in the luminance of the image displayed on the screen.

When the coefficient calculating section 164 calculates the correction coefficients Cr', Cg' and Cb', it inputs the calculated correction coefficients Cr', Cg' and Cb' into the signal level correcting section 128. The signal level correcting section 128 multiples the video signals by the input correction coefficients Cr', Cg' and Cb' (step S112).

The signal level correcting section 128 multiplies the respective colors R, G and B by the correction coefficients Cr', Cg' and Cb'. That is to say, the red video signal is multiplied by the correction coefficient Cr' for correcting the red signal level, the green video signal is multiplied by the correction coefficient Cg' for correcting the green signal level, and the blue video signal is multiplied by the correction coefficient Cb' for correcting the blue signal level.

When the signal level correcting section 128 multiplies the video signals by the correction coefficients, so as to adjust the levels of the video signals input into the signal level correcting section 128. As a result of the multiplication by the correction coefficients in the signal level correcting section 128, the levels of the video signals are adjusted so that the luminance of an image displayed through the panel 158 can be reduced.

The above described the still image determining method according to one embodiment of the present invention. In the still image determining method, a computer program which is created for executing the still image determining method according to one embodiment of the present invention is recorded in a recording medium (for example, the recording section 106) in the display device 100 in advance, and an operating device (for example, the control section 104) may successively read and execute the computer program.

According to one embodiment of the present invention, the last levels of the video signals are compared with the present levels of video signals, and the determination is made whether a still image is displayed based on the difference between both the levels. The degree of still image is updated according to the determined result, so that the detection can be made whether the still image is continuously displayed on the screen. When the correction coefficients (gains) for reducing the luminance in a region where a still image is displayed are calculated according to the degree of still image, the luminance of an image displayed on the screen is reduced, so that the burn-in phenomenon can be prevented.

Since the various signal processes on the video signals having linear property are executed by simple operations, the circuit which performs the operations may have a simple configuration. This results in reducing the entire area of the circuit, and thus the display device 100 is thinned and lightweighted.

It should be understood by those skilled in the art that various modifications, combinations, sub-combinations and alternations may occur depending on design requirements and other factors insofar as they are within the scope of the appended claims or the equivalents thereof.

For example, in this embodiment, the still image determining section 162 calculates the degree of still image, calculates correction values based on the calculated degree of still image, and sends the calculated correction values to the signal level correcting section 128. The signal level correcting section 128 multiples video signals by the correction values so as to correct the levels of the video signals. However, the present invention is not limited to this example. For example, the control section 104 may calculate the degree of still image, may send the calculated degree of still image to the signal level correcting section 128 may calculate correction values so as to multiply the video signals by the correction values.

What is claimed is:

1. A display device which has (a) a display section comprising a plurality of pixels arranged in a matrix form, each pixel comprising (i) a light emitting element for emitting light according to a current amount and (ii) a pixel circuit for controlling an electric current applied to the light emitting element according to a video signal, (b) scanning lines which supply selection signals for selecting the pixels for emitting light to the pixels in a predetermined scanning cycle, and (c) data lines which supply the video signals to the pixels, the display device comprising:

an average value calculating section configured to input video signals having a linear property and calculates an average value of levels of the video signals having a linear property per pixel by successively acquiring signal levels of a plurality of colors in a plurality of regions of the display section from a plurality of frames;

an average value memory section configured to sequentially store the average value calculated by the average value calculating section;

a still image determining section configured to determine a degree of still image for each region of the display section based on a difference between the average value stored in the average value memory section and a last average value;

a coefficient calculating section configured to calculate coefficients for reducing luminance based on the determined degrees of still image of each region of the display section; and a coefficient multiplying section configured to multiply the video signals by the coefficients calculated by the coefficient calculating section, wherein, the coefficients include a first coefficient for reducing luminance of the entire display section and a second coefficient for reducing luminance of a region in the display section where a highest degree of still image is determined, and the second coefficient for reducing luminance is calculated based on comparing a current highest degree of still image and a previous highest degree of still image.

2. The display device according to claim 1, further comprising a linear converting section configured to convert video signals having gamma property into the video signals having linear property.

3. The display device according to claim 1, further comprising a gamma converting section configured to convert output signals having linear property in the coefficient multiplying section into signals having gamma property.

4. The display device according to claim 1, wherein the still image determining section divides the display section into the plurality of regions, determines whether a still image is displayed on each of the regions based on the corresponding degree of still image, and when determining that the still image is displayed on at least one of the regions, determines that the still image is displayed on the entire screen.

5. The display device according to claim 4, wherein the still image determining section divides the display section into a plurality of regions where a number of pixels of one side is an exponentiation of 2.

6. A method for driving a display device, which has (a) a display section comprising a plurality of pixels arranged in a matrix form, each pixel comprising (i) a light emitting element for emitting light according to a current amount and (ii) a pixel circuit for controlling an electric current applied to the light emitting element according to a video signal, (b) scanning lines which supply selection signals for selecting the pixels for emitting light to the pixels in a predetermined scanning cycle, and (c) data lines which supply the video signals to the pixels, the method comprising the steps of:

inputting video signals having a linear property and calculating an average value of levels of the video signals per pixel by successively acquiring signal levels of a plurality of colors in a plurality of regions of the display section from a plurality of frames;

storing the calculated average value;

determining a degree of still image for each region of the display section based on a difference between the average value stored at the average value storing step and a last average value;

calculating coefficients for reducing luminance of an image displayed on the display section based on the determined degrees of still image of each region of the display section; and multiplying the video signals by the coefficients calculated at the coefficient calculating step, wherein, the coefficients include a first coefficient for reducing luminance of the entire display section and a second coefficient for reducing luminance of a region in the display section where a highest degree of still image is determined, and the second coefficient for reducing luminance is calculated based on comparing a current highest degree of still image and a previous highest degree of still image.

7. A non-transitory computer readable medium having a computer program which allows a computer to control a display device having (a) a display section comprising a plurality of pixels arranged in a matrix form, each pixel comprising (i) a light emitting element for emitting light according to a current amount and (ii) a pixel circuit for controlling an electric current applied to the light emitting element according to a video signal, (b) scanning lines which supply selection signals for selecting the pixels for emitting light to the pixels in a predetermined scanning cycle, and (c) data lines which supply the video signals to the pixels, the computer program comprising the steps of:

inputting video signals having linear property and calculating an average value of levels of the video signals per pixel by successively acquiring signal levels of a plurality of colors in a plurality of regions of the display section from a plurality of frames;

storing the calculated average value;

determining a degree of still image for each region of the display section based on a difference between the average value stored at the average value storing step and a last average value;

calculating coefficients for reducing luminance of an image displayed on the display section based on the determined degrees of still image of each region of the display section; and multiplying the video signals by the coefficients calculated at the coefficient calculating step, wherein, the coefficients include a first coefficient for reducing luminance of the entire display section and a second coefficient for reducing luminance of a region in the display section where a highest degree of still image is determined, and the second coefficient for reducing luminance is calculated based on comparing a current highest degree of still image and a previous highest degree of still image.

* * * * *